United States Patent [19]

Ryden et al.

[11] 4,012,615

[45] Mar. 15, 1977

[54] LATCH FOR A CIRCUIT INTERRUPTER

[75] Inventors: Howard R. Ryden, Forest Hills Borough; John A. Wafer, Monroeville; Paul G. Slade, Pittsburgh, all of Pa.

[73] Assignee: Westinghouse Electric Corporation, Pittsburgh, Pa.

[22] Filed: July 24, 1975

[21] Appl. No.: 598,618

[52] U.S. Cl. ..... 200/325

[51] Int. Cl.[2] ..... H01H 3/12

[58] Field of Search ..... 200/318, 319, 321, 323, 200/324, 325, 327

[56] References Cited

UNITED STATES PATENTS

| | | | |
|---|---|---|---|
| 2,810,050 | 10/1957 | Johnson | 200/319 |
| 3,686,601 | 7/1970 | Kaczmarek et al. | 200/325 |

*Primary Examiner*—Herman J. Hohauser
*Attorney, Agent, or Firm*—Robert E. Converse, Jr.

[57] ABSTRACT

A latch for a circuit interrupter is provided wherein a movable member having a contact attached thereto is latched in a selected position by a spring member which is deflected by the movable member until a predetermined distance is exceeded at which time the spring member moves into a latching position with respect to a latching surface provided on the movable member. In its simplest form the latch uses a single piece of spring wire. As a movable member moves past, the spring wire moves aside and once the movable member has completely passed the wire, the wire springs back into place preventing the contacts from reclosing. A reset is provided which permits the contact arms to be closed by moving the spring member to one side. The disclosed latch is very fast acting, can be independently actuated for each phase, and can be positioned so as to not interfere with low current operation of the switching device on which it is employed.

7 Claims, 8 Drawing Figures

CLOSED

OPEN

LATCH FOR A CIRCUIT INTERRUPTER

CROSS-REFERENCE TO RELATED APPLICATIONS

This latch is particularly suitable for applications on a circuit interrupter as is disclosed in U.S. patent application Ser. No. 437,586, or on a motor controller as disclosed in U.S. patent application Ser. No. 613,840.

BACKGROUND OF THE INVENTION

1. Field of the Invention

This invention relates to a fast-acting latch and more particularly to a spring latch which is particularly suitable for use on a circuit interrupter or circuit controller.

2. Description of the Prior Art

During the development of a current limiting circuit breaker as disclosed in U.S. patent application Ser. No. 437,586 and an integral motor controller as disclosed in U.S. patent application Ser. No. 613,840 the applicants recognized that a new type of latch for the moving contact arm was required. Operation of the latches as used on conventional circuit interrupters and circuit breakers were not satisfactory. It was determined by the inventors that the latch had to satisfy a number of requirements including: low cost, very rapid operation, lack of effect on the opening speed of the contact arm, independent latching of the contact arm in each phase, easy resettability, and straightforward simple design. The inventors are not aware of any prior art latch which satisfies all these requirements.

SUMMARY OF THE INVENTION

A latch is provided which is particularly adaptable for use on circuit controlling apparatus, where a spring member is disposed in proximity to a bore through a fixed member which is used to latch a movable member connected to the contacts utilized. The spring member can be a wire or a leaf spring member. The spring can be disposed outside of the bore in the fixed body member or it can project within the bore through the fixed body member. The disclosed latch is low cost, operates very rapidly, does not affect the opening speed of the circuit interrupter, latches each arm independently, and is of a straightforward simple construction. The disclosed device has been found to be particularly useful on current limiting devices which utilize the linear slot motor concept to open electric contacts very rapidly. The disclosed latch, however, is not restricted to those devices which employ the linear slot motor, it is rather a general latch that can be used for a number of mechanical devices.

In one embodiment of the invention the latch comprises a member having a bore formed therethrough and a wire member, formed of a spring material and having one fixed end, extending across the bore. A movable member which is latched by the spring member has a portion disposed within the bore which includes a tapered portion constructed for easily pushing the spring aside and a latch surface constructed to be retained by the wire member when the movable member has travelled a predetermined distance. A reset is also provided for moving the wire member aside permitting the movable member to move to an unlatched position. When used with a circuit interrupter having a bridging contact arm the movable member can be attached to the movable contact arm for movement therewith. When the bridging contact arm is rapidly moved to an open position the spring wire moves to a latching position preventing the bridging contact arm from returning to the closed position.

In another embodiment of the invention a flat leaf spring can be used for latching the movable member. When the tapered portion, which can be in the form of a cone, moves the leaf spring the spring is pushed back until the latching surface is moved into position to be engaged. In any embodiment, more than one latching spring member can be utilized.

It is an object of this invention to teach a latch wherein a member formed of spring wire directly latches a movable member as it moves through a bore or opening in an adjacent piece.

It is a further object of this invention to disclose a fast acting relatively simple direct spring latch particularly suitable for use on current switching apparatus.

BRIEF DESCRIPTION OF THE DRAWINGS

For a better understanding of the invention, reference may be had to the preferred embodiments exemplary of the invention shown in the accompanying drawings, in which.

DESCRIPTION OF THE PREFERRED EMBODIMENTS

Figure 1:
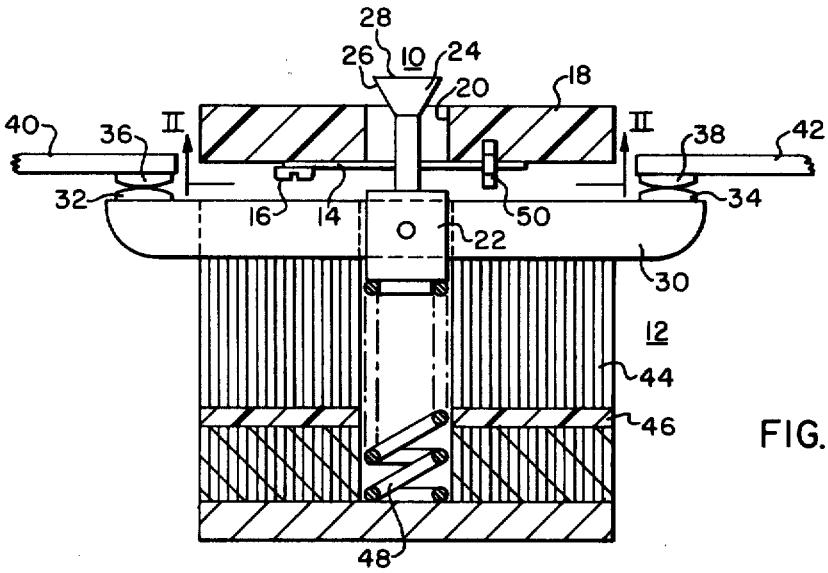
FIG. 1 is a side view of a circuit interrupter utilizing a latch constructed in accordance with the teaching of the present invention.
Figure 2:
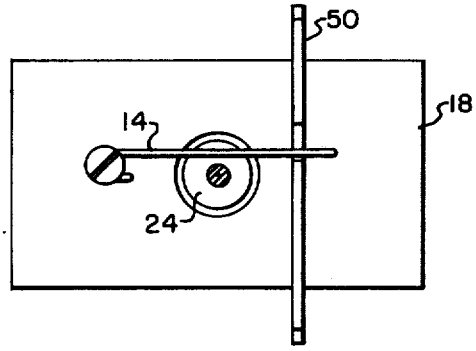
FIG. 2 is a view of the latch shown in FIG. 1 along the lines II—II.
Figure 3:
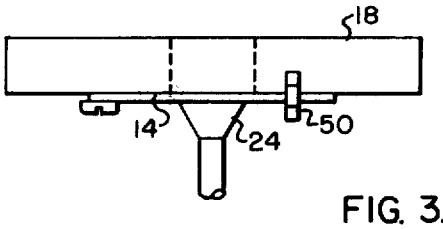
FIG. 3 is a view of a portion of the latch shown in FIG. 1 in the latched position.
Figure 4:
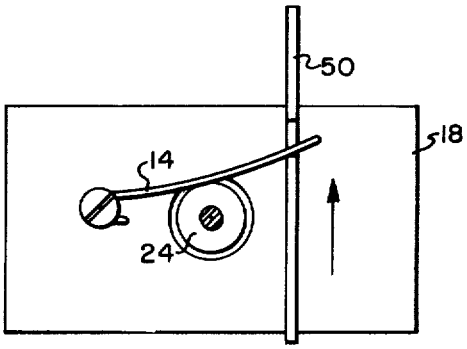
FIG. 4 is a view similar to FIG. 2 but showing the reset position of the spring member.

Referring now to the drawings and FIG. 1 in particular, there is shown a latch 10 utilizing the teaching of the present invention. Latch 10 is shown here used on a current limiting circuit interrupter 12 as described more fully in U.S. patent application Ser. No. 437,586. Circuit interrupter 12 provides for current limiting and requires a very fast acting latch 10. A single piece of spring wire 14 is rigidly secured at one end by a fastener 16 to an insulating block 18. A bore or opening 20 is formed through insulating block 18. A movable guide member 22 is disposed with a portion projecting into the bore 20 of insulating block 18. One end of guide member 22 has the shape of an inverted cone 24. The cone 24 has tapered sides 26 and a flat latching surface 28. When guide member 22 moves in the direction pointed by cone 24 the cone 24 moves past the latch wire spring 14 which is moved to one side. When guide member 22 has moved sufficiently so that latch wire 24 is past the tapered surface 28, latch wire 24 springs back in place preventing backward movement of guide member 22. Guide member 22 is attached to a bridging contact arm 30. Bridging contact arm 30 is supported for rectilinear movement. Attached to bridging contact arm 30 are spaced apart contacts 32 and 34. Disposed opposite contacts 32 and 34 are fixed contacts 36 and 38. Bridging contact arm 30 is movable between an open position wherein contact pairs 32–36 and 34–38 are separated and a closed position wherein contact 32 engages contact 36 and contact 34 engages contact 38. When bridging contact arm 30 is in the closed position, a series circuit exists through interrupter 12 from terminal 40 through contact pairs 32–36 through bridging contact arm 30 through contact pairs 34–38 to terminal 42. Bridging contact arm 30 is disposed within a narrow slot formed in a yoke 44 of magnetizable material which concentrates the magnetic forces generated during high fault currents to rapidly open the circuit interrupter 12. The operation of the disclosed circuit interrupter 12 is more fully described in copending U.S. patent application No. 437,586. Upon the occurrence of high fault current, the self-induced magnetic forces rapidly force bridging contact arm 30 to an open position. A pad 46 formed of resilient material is disposed in the closed end of the slot in yoke 44. This provides a cushion when bridging contact arm 30 is thrown rapidly open. A spring 48 is disposed to contact guide member 22 and to spring bias bridging contact arm 30 to the closed position. Bridging contact arm 30 is held in place by guide member 22 which rides in an insulated opening through yoke 44. The contact closing force is provided by spring 48. On a high fault current flow through circuit interrupter 12 the forces generated overcome the closing force provided by spring 48 and bridging contact arm 30 is moved to the open position. Attached guide member 22 is also moved so that the inverted cone 24 moves past latch wire 14. The latch wire 14 then springs back into place. When contact arm 30 is in the open position and any arc formed during circuit interruption has been extinguished, all magnetic forces are eliminated and the spring 48 urges bridging contact arm 30 to the closed position. However, at this point, guide member 22 is held in the open position by spring wire 14 as can best be seen in FIG. 3.

During circuit interruption, after bridging contact arm 30 has travelled to the end of its stroke, spring 48 tries to return to the closed position but the flat side 28 of cone 24 is forced against the latch wire 14 and prevents reclosing. When the flat latching side 28 of cone 24 hits the latch wire 14, the latch wire 14 bends slightly absorbing some of the energy of impact.

In order to reset the latch a reset arm 50 is provided. To reset the latch 10 spring wire 14 is moved to one side by moving reset member 50 which slides in a slot provided in insulating block 18. This will cause spring wire 14 to be moved out of engagement with surface 28 and spring 48 will then force bridging contact arm 30 to a closed position wherein contact pairs 32–36 and 34–38 are closed.

Movement of the guide member 22 during high fault current is very rapid and prior art latches investigated were not quick enough to repeatedly latch guide member 22 under varying fault conditions.

Figure 5:
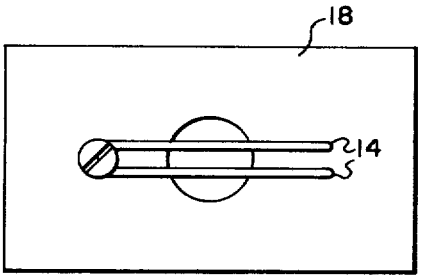
FIG. 5 is a view of the spring latch utilizing two spring members.
Figure 6:
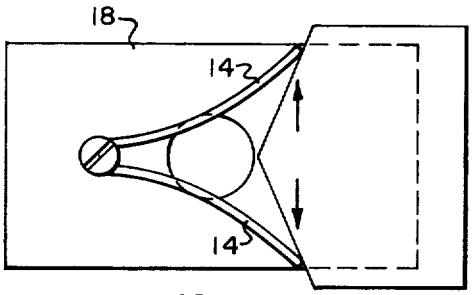
FIG. 6 is similar to FIG. 5 but with the spring members in the reset position.

FIGS. 5 and 6 show a latch utilizing a double latching wire. This variation may be advantageous under some circumstances. A wedge arrangement can be used to spread the wires apart for reset as shown in FIG. 6.

Figure 7:
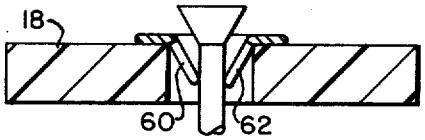
FIG. 7 is a side sectional view of another embodiment of a latch utilizing the teaching of the present invention; and, FIG. 8 is a side sectional view of another embodiment of a latch utilizing the teaching of the present invention used on a current limiting circuit interrupter.

Another embodiment of the invention is shown in FIG. 7 wherein the spring wires are replaced by flat leaf springs 60 and 62. The leaf springs can project into the bore through insulating member 18 if desired.

Figure 8:
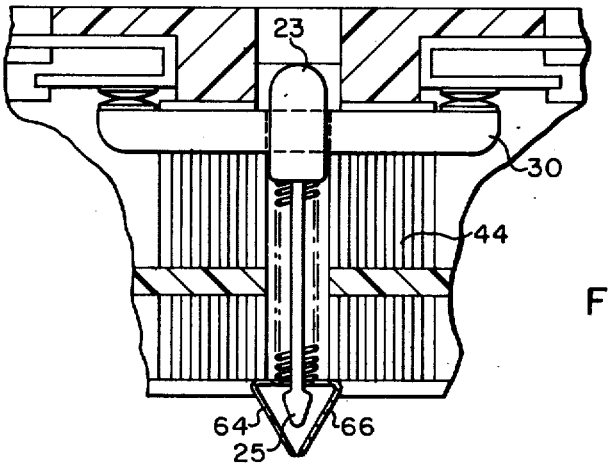

Another embodiment of the invention is shown in FIG. 8 wherein the latching cone is attached to the opposite side of the bridging contact arm 30. In this embodiment an insulating block is not required and a portion of the guide member 23 projects through the bore or opening in magnetic yoke 44. As bridging contact arm 30 moves to the open position the cone shaped portion 25 spreads the leaf springs 64 and 66 until the cone 25 has passed therebetween at which time the leaf springs 64 and 66 spring back into position latching contact arm 30 in the open position. The latch shown in FIG. 8 has been tested on a current limiting circuit interrupter as shown for interrupting possible 100,000 ampere fault currents in a 600 volt circuit.

The disclosed latch has numerous advantages such as being very fast acting and of a relatively low cost. Since only the spring wire must be moved and this is not necessary until the bridging contact arm has started moving, the mass of the moving assembly has been kept small. This is in contrast to prior art linkage type latches wherein parts of the latch must also be moved by the contact arm. Since the acceleration of the contact arm is related directly to the mass, this results in an improved performance and increased current limiting. Each arm of a multiphase breaker can be latched independently and all the contact arms can be reset simultaneously. This construction also permits easy replacement of the bridging contact arm. The bridging contact arm 30 can easily be replaced by removing the fastening tube guide member. There is no critical realignment during assembly. When a contact arm is latched it indicates that the fault in the phase in which it is activated is greater than the threshold current for the current limiter. The latch therefore can also act as an indicator on a multipole device to show on which pole the fault occurs. Latch 10 also acts as in indicator to show that the fault which occurred is greater than the threshold level which is usually set at about 10 times the rated current for a current limiting circuit interrupter. In an integral motor controller as disclosed in copending U.S. patent application Ser. No. 613,840, the contacts are separated approximately 1/4 inch during normal on-off operation by a solenoid. Good mechanic life is essential and several million operations are required. During these operations, the latching spring does not contact the inverted cone so that there is no mechanical wear. The mechanical wear required for the spring latch 10 is on the order of a few hundred operations.

We claim:

1. A latch comprising:

a block having a bore therethrough;

a wire member formed of a spring material, extending transverse across the bore through said block and having one end fixed with respect to said block;

a movable member having a portion disposed for movement within the bore of said block comprising a tapered portion constructed for easy movement of said wire member and a latching surface constructed to be restrained by said wire member and being movable to a latched position wherein said latching surface is in contact with said wire member and an unlatched position wherein said latch surface is spaced from said wire member.

2. A latch as claimed in claim 1 comprising:

biasing means connected to said movable member for biasing said movable member to an unlatched position; and, reset means connected to said wire member for moving said wire member to a position out of contact with said latch surface allowing said movable member to move to the unlatched position.

3. A circuit interrupter comprising:

a bridging contact arm supported for rectilinear movement, to complete a series circuit through the circuit interrupter;

a movable guide member attached to said bridging contact arm;

a body member having a bore therein through which a portion of said movable guide member can move and a spring member relatively fixed with respect to said body member and projecting within the area at some longitudinal point defined by the bore through said body member;

said movable guide member being movable between a latched position and an unlatched position and comprising a latching surface which engages said spring member when said movable guide member is in the latched position and a tapered portion which engages said spring member as said movable member is moved from the unlatched position to the latched position.

4. A circuit interrupter as claimed in claim 3 comprising:

biasing means biasing said movable guide member towards a latched position; and, reset means associated with said spring member for moving said spring member out of engagement with said movable guide member.

5. A circuit interrupter as claimed in claim 4 wherein:

said spring member comprises spring wire having one end fixed relative to said body member said spring wire extending transverse to the bore through said body member.

6. A circuit interrupter as claimed in claim 4 wherein:

said spring member comprises a leaf spring extending into the bore of said body member.

7. A circuit interrupter as claimed in claim 4 comprising:

a second spring member relatively fixed with respect to said body member and projecting within the area at some longitudinal point defined by the bore through said body member.

* * * * *